US007150237B2

(12) United States Patent
Lin et al.

(10) Patent No.: US 7,150,237 B2
(45) Date of Patent: Dec. 19, 2006

(54) BLOW-MOLDED TABLE

(75) Inventors: Wen-Shen Lin, Kaohsiung (TW); Hsin-Hung Tsai, Jiayi Hsien (TW)

(73) Assignee: Maxchief Investments, Ltd., Hong Kong (HK)

( * ) Notice: Subject to any disclaimer, the term of this patent is extended or adjusted under 35 U.S.C. 154(b) by 273 days.

(21) Appl. No.: 10/763,151

(22) Filed: Jan. 21, 2004

(65) Prior Publication Data

US 2005/0155532 A1 Jul. 21, 2005

(51) Int. Cl.
*A47B 3/00* (2006.01)

(52) U.S. Cl. ..... 108/132; 108/115

(58) Field of Classification Search ..... 108/115, 108/129, 130, 131, 132, 118, 119, 120, 121, 108/125; 248/188.6, 188
See application file for complete search history.

(56) References Cited

U.S. PATENT DOCUMENTS 1,560,913 A * 11/1925 Johnson ..... 108/129
1,905,219 A * 4/1933 Crichton ..... 108/125
1,959,725 A * 5/1934 Lindsay ..... 108/132
5,279,233 A * 1/1994 Cox ..... 108/129
6,550,404 B1 * 4/2003 Stanford ..... 108/132
6,622,644 B1 * 9/2003 Buono ..... 108/132
6,659,021 B1 * 12/2003 Wen ..... 108/125
6,823,806 B1 * 11/2004 Buono ..... 108/132
2003/0233968 A1 * 12/2003 Strong et al. ..... 108/132
2004/0031422 A1 * 2/2004 Wong ..... 108/132
2004/0244656 A1 * 12/2004 Shenghao et al. ..... 108/132

* cited by examiner

*Primary Examiner*—Janet M. Wilkens
*Assistant Examiner*—Timothy Ayres
(74) *Attorney, Agent, or Firm*—Luedeka, Neely & Graham

(57) ABSTRACT

A blow-molded table includes a table board, and two opposite support units each foldably mounted on a bottom of the table board. Each of the two support units includes a support stand pivotally mounted on either one of two ends of the table board, and a support member pivotally mounted on a mediate of the table board and pivotally connected with the support stand. Thus, the blow-molded table is supported rigidly and stably when being expanded and is folded when not in use.

5 Claims, 14 Drawing Sheets

BLOW-MOLDED TABLE

BACKGROUND OF THE INVENTION

1. Field of the Invention

The present invention relates to a blow-molded table, and more particularly to a blow-molded table that is expanded easily and rapidly and is folded easily when not in use, thereby enhancing the versatility of the blow-molded table.

2. Description of the Related Art

A conventional table is available for providing a support effect, thereby facilitating the user using the table. However, the conventional table has a fixed structure and cannot be folded when not in use, thereby increasing space of storage, and thereby causing inconvenience in storage, package and transportation.

SUMMARY OF THE INVENTION

The primary objective of the present invention is to provide a blow-molded table that is supported rigidly and stably when being expanded and is folded when not in use, thereby enhancing the versatility of the blow-molded table.

Another objective of the present invention is to provide a blow-molded table, wherein the two support units are expanded outward rapidly to support the table board rigidly and stably, thereby facilitating the user expanding the blow-molded table.

A further objective of the present invention is to provide a blow-molded table, wherein the support units are folded in the receiving space of the table board to fold the blow-molded table when not in use, thereby saving space of storage, package and transportation.

In accordance with the present invention, there is provided a blow-molded table, comprising a table board, and two opposite support units each foldably mounted on a bottom of the table board, wherein:

the bottom of the table board is formed with a receiving space; and each of the two support units is mounted in the receiving space of the table board and includes a support stand pivotally mounted on either one of two ends of the table board, and a support member pivotally mounted on a mediate of the table board and pivotally connected with the support stand.

Further benefits and advantages of the present invention will become apparent after a careful reading of the detailed description with appropriate reference to the accompanying drawings.

DETAILED DESCRIPTION OF THE INVENTION

Figure 1:
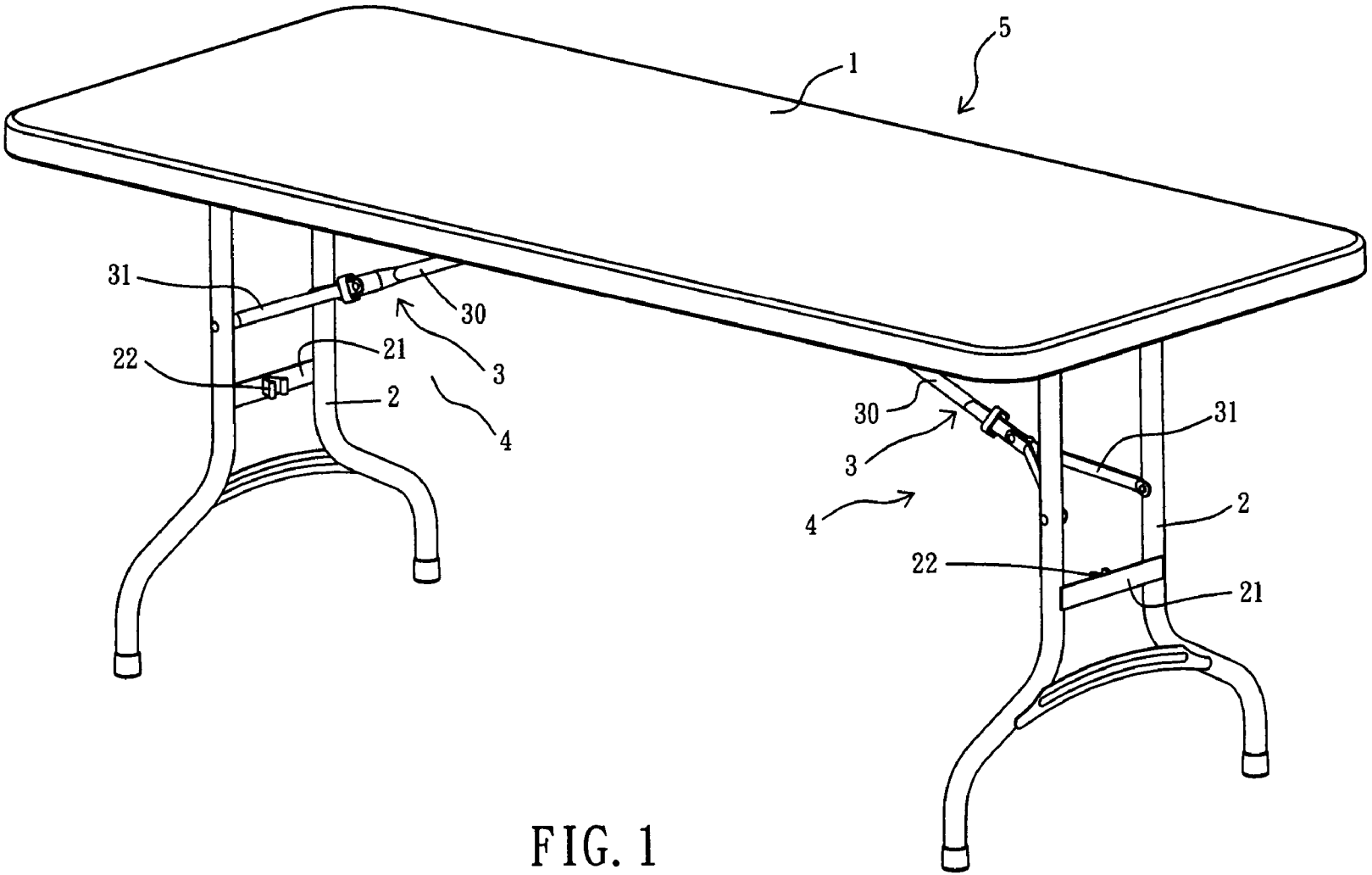
FIG. 1 is a perspective view of a blow-molded table in accordance with the preferred embodiment of the present invention.

Referring to the drawings and initially to FIGS. 1–7, a blow-molded table 5 in accordance with the preferred embodiment of the present invention comprises a table board 1, and two opposite support units 4 each foldably mounted on a bottom of the table board 1.

Figure 5:
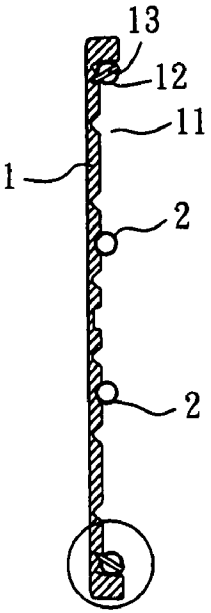
FIG. 5 is a plan cross-sectional view of the blow-molded table taken along line 5—5 as shown in FIG. 4.
Figure 7:
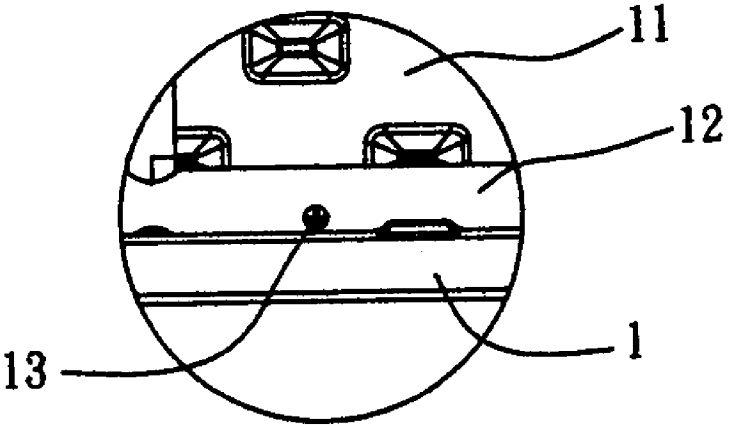
FIG. 7 is a partially enlarged view of the blow-molded table as shown in FIG. 4.
Figure 6:
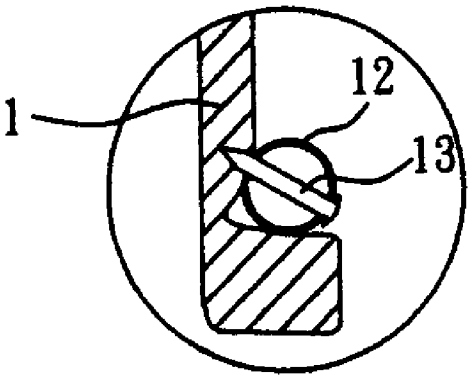
FIG. 6 is a partially enlarged view of the blow-molded table as shown in FIG. 5.

The bottom of the table board 1 is formed with a receiving space 11. The receiving space 11 of the table board 1 has two opposite sides each provided with a support tube 12 which is secured on the table board 1 by a plurality of screws 13 as shown in FIGS. 5–7.

Each of the two support units 4 is mounted in the receiving space 11 of the table board 1 and includes a support stand 2 pivotally mounted on one of two ends of the table board 1, and a support member 3 pivotally mounted on a mediate of the table board 1 and pivotally connected with the support stand 2.

The support stand 2 of each of the two support units 4 is provided with an auxiliary reinforcement member 21 having a mediate portion formed with a substantially C-shaped holder 22. The support stands 2 of the two support units 4 are in alignment with each other as shown in FIG. 3.

The support member 3 of each of the support units 4 includes a substantially T-shaped support bar 30 having a first end pivotally mounted on the mediate portion of the table board 1, and a substantially V-shaped extension bar 31 having a first end pivotally mounted on a second end of the support bar 30 and a second end pivotally mounted on the support stand 2. The support bars 30 of the two support units 4 are juxtaposed to each other as shown in FIG. 2.

The receiving space 11 of the table board 1 is formed with a plurality of receiving recesses 14 for receiving the support stand 2 and the support member 3 of each of the support units 4 when being folded.

Figure 2:
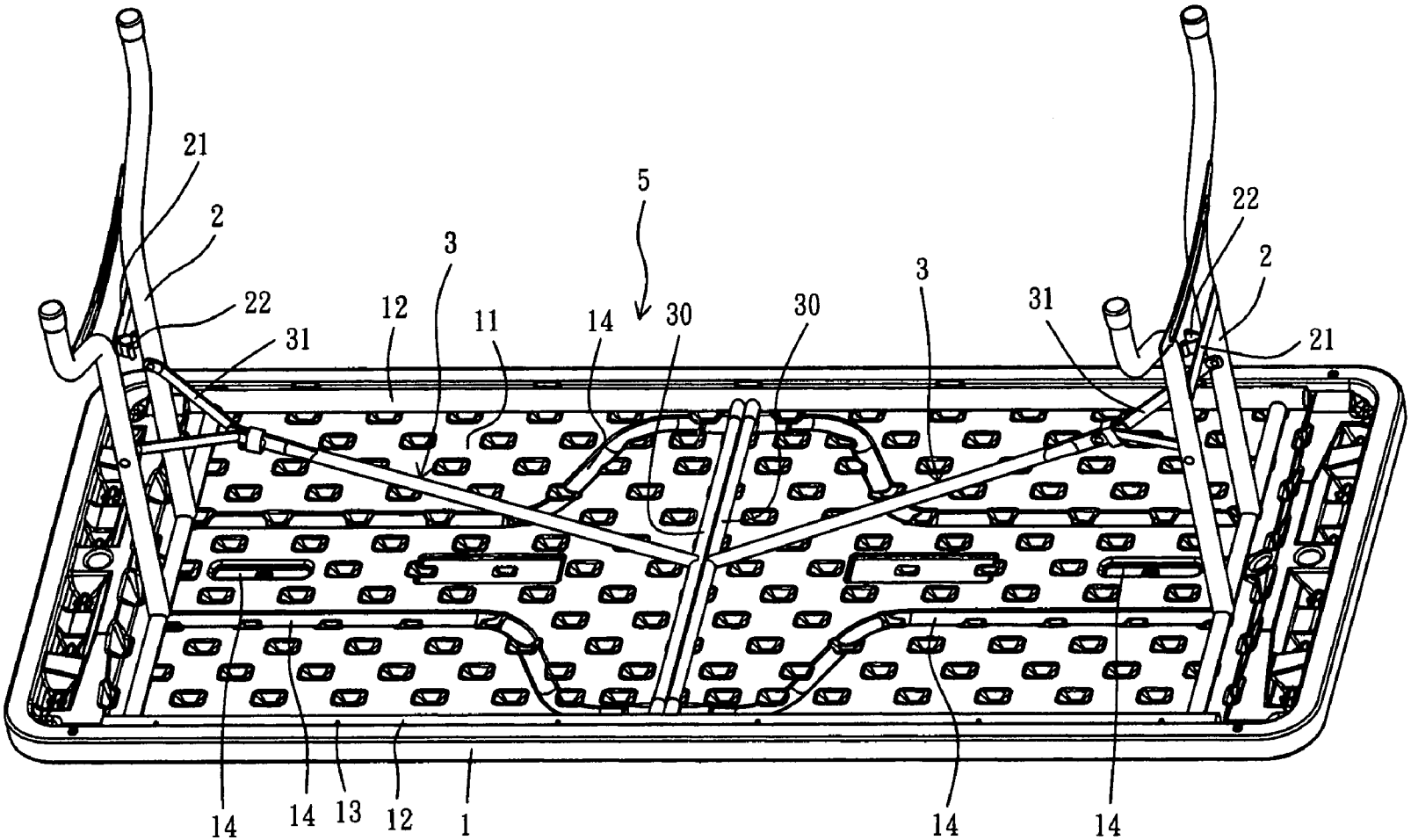
FIG. 2 is a bottom perspective view of the blow-molded table as shown in FIG. 1.
Figure 3:
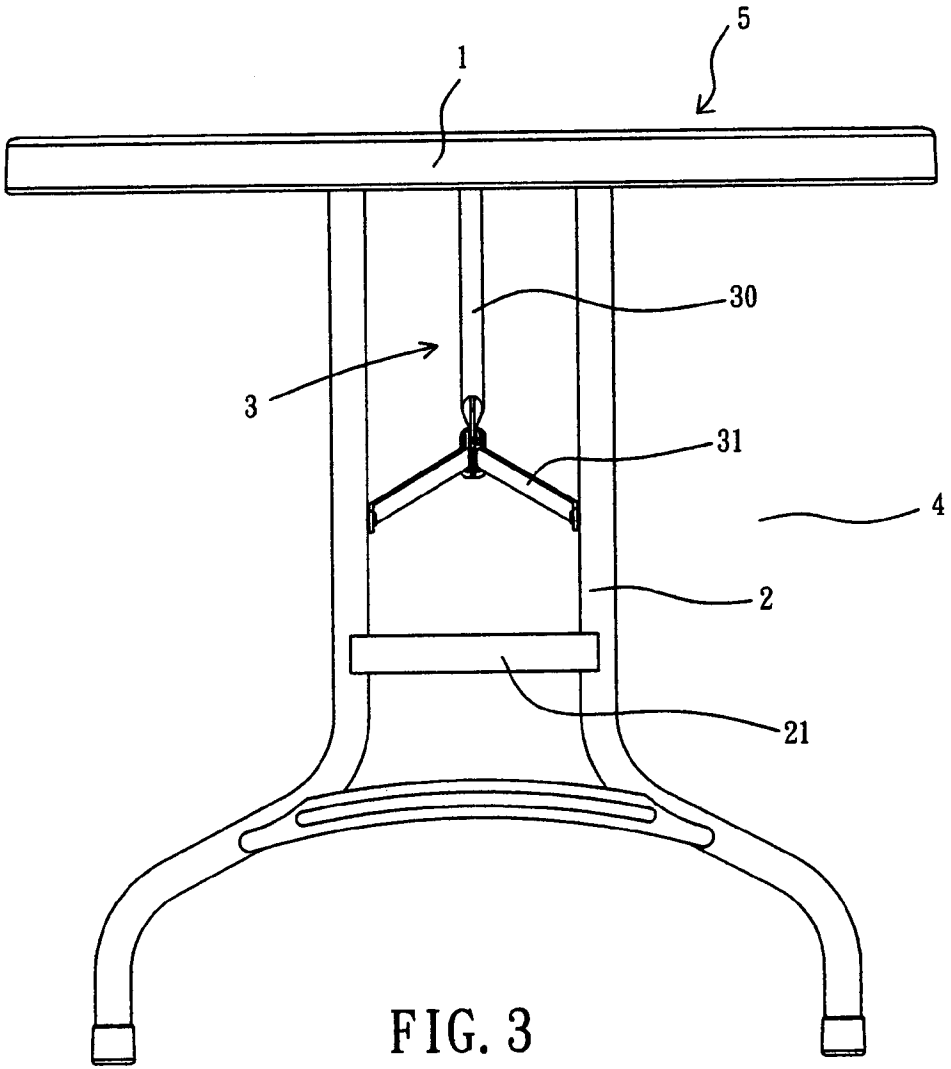
FIG. 3 is a side plan view of the blow-molded table as shown in FIG. 1.

In practice, as shown in FIGS. 1–3, the support stand 2 of each of the support units 4 is pulled outward relative to the table board 1 to drive the support member 3 to extend outward, thereby fully stretching the support member 3, so that the table board 1 is supported by the two support units 4 rigidly and stably, thereby fully expanding the blow-molded table 5 as shown in FIG. 1.

Figure 4:
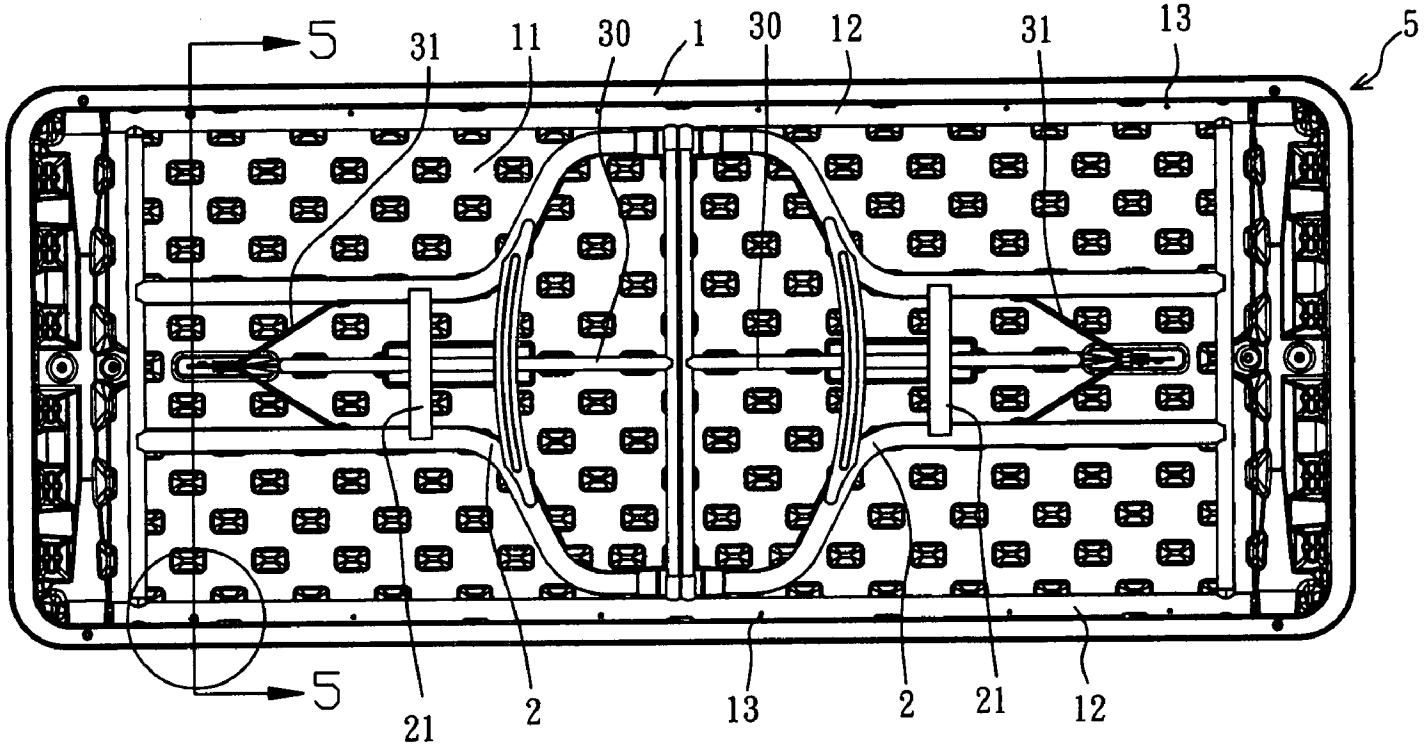
FIG. 4 is a bottom plan folded view of the blow-molded table as shown in FIG. 1.

As shown in FIGS. 4–7, when the user wishes to fold the blow-molded table 5, the support stand 2 of each of the support units 4 is pressed toward the table board 1 to drive the extension bar 31 and the support bar 30 of the support member 3 to move and pivot inward, thereby moving and folding the support member 3 and the support stand 2 into the receiving recesses 14 of the table board 1, so that the support units 4 are folded in the receiving space 11 of the table board 1, thereby folding the blow-molded table 5 as shown in FIG. 4. When the support member 3 and the support stand 2 are folded, the holder 22 of the support stand 2 is clamped on the support bar 30 of the support member 3, so that the support member 3 is combined with the support stand 2.

Accordingly, the two support units 4 are expanded outward rapidly to support the table board 1 rigidly and stably, thereby facilitating the user expanding the blow-molded table 5. In addition, the support units 4 are folded in the receiving space 11 of the table board 1 to fold the blow-molded table 5 when not in use, thereby saving space of storage, package and transportation.

Figure 8:
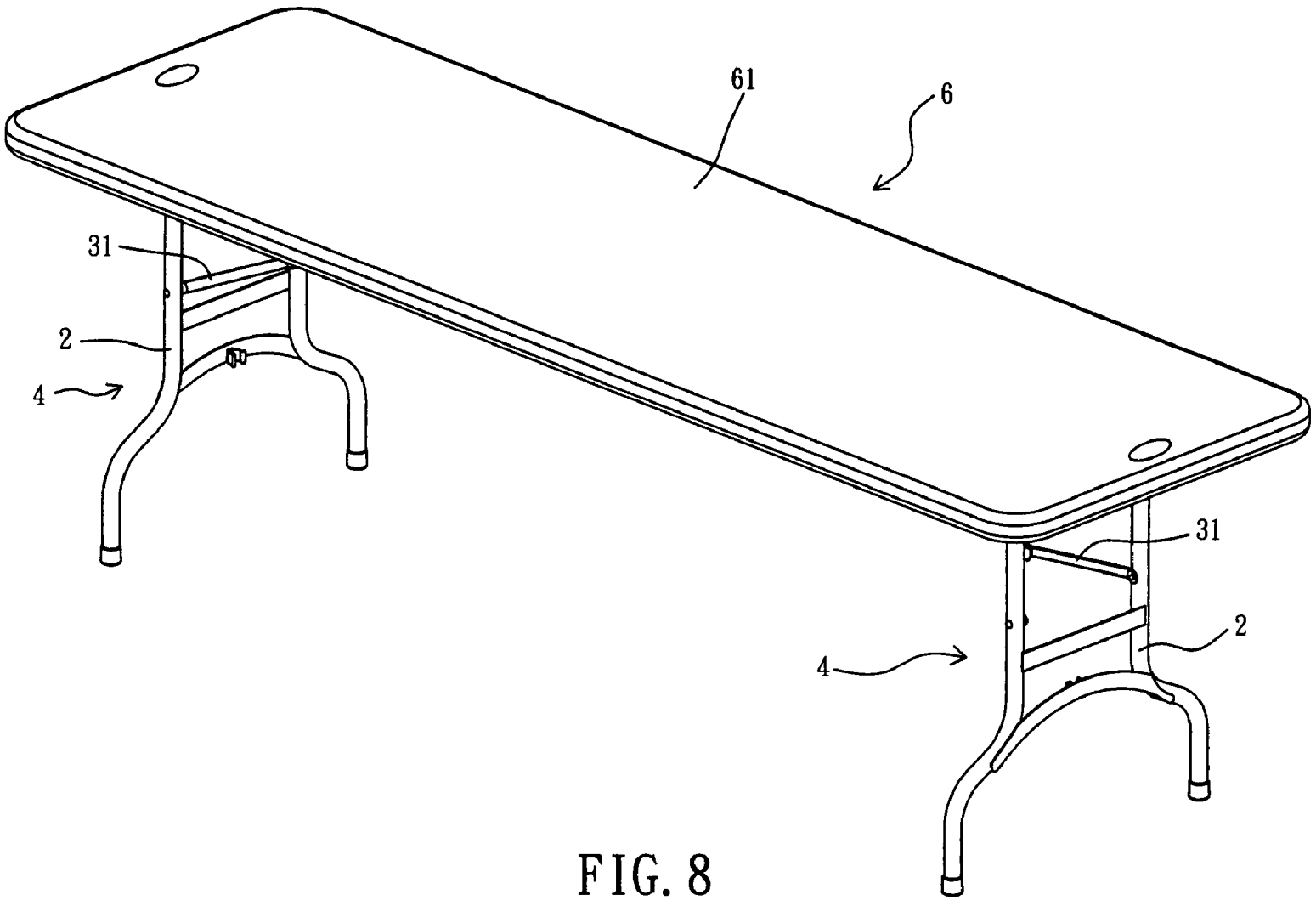
FIG. 8 is a perspective view of a blow-molded table in accordance with another embodiment of the present invention.
Figure 9:
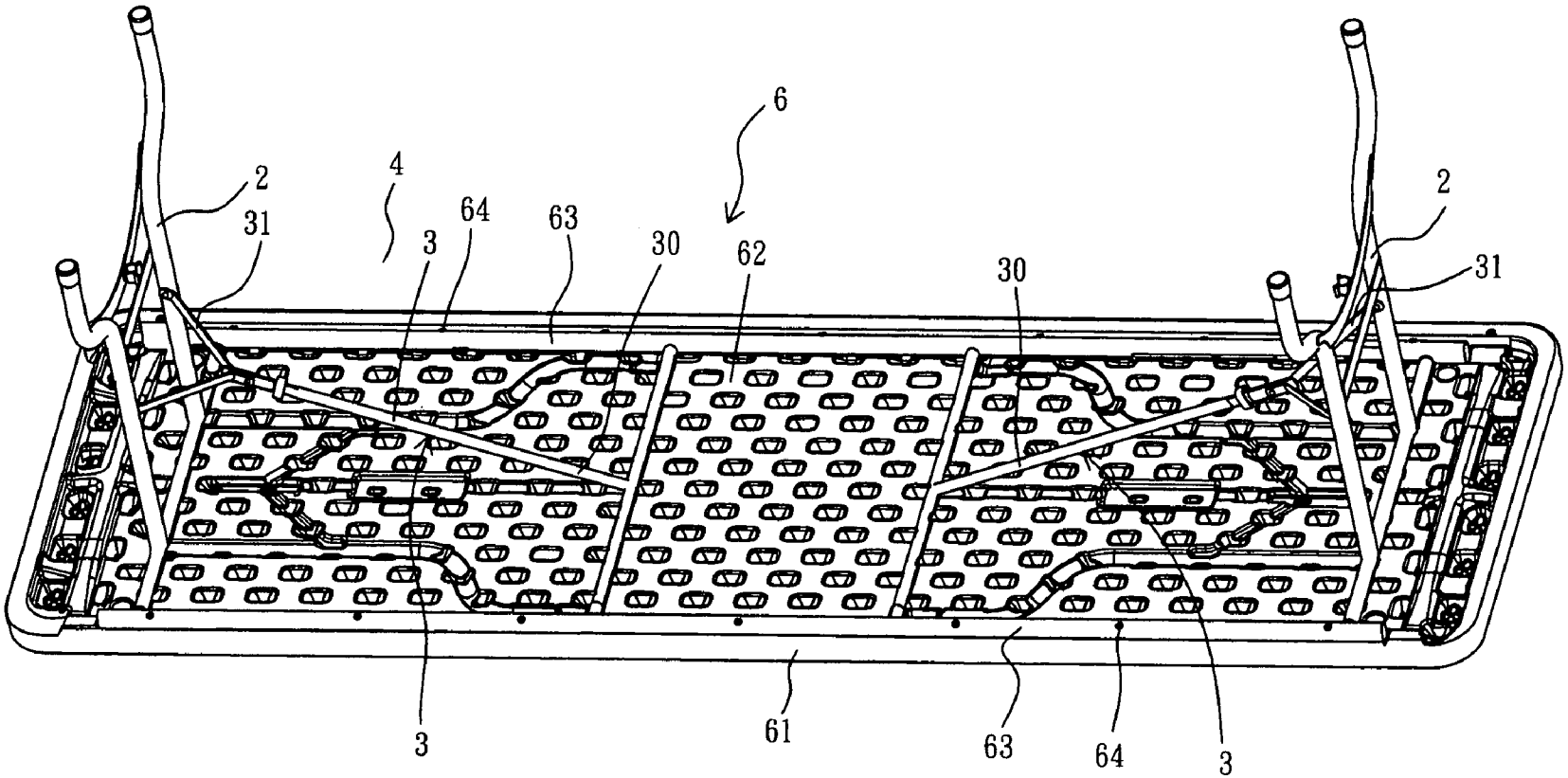
FIG. 9 is a bottom perspective view of the blow-molded table as shown in FIG. 8.
Figure 10:
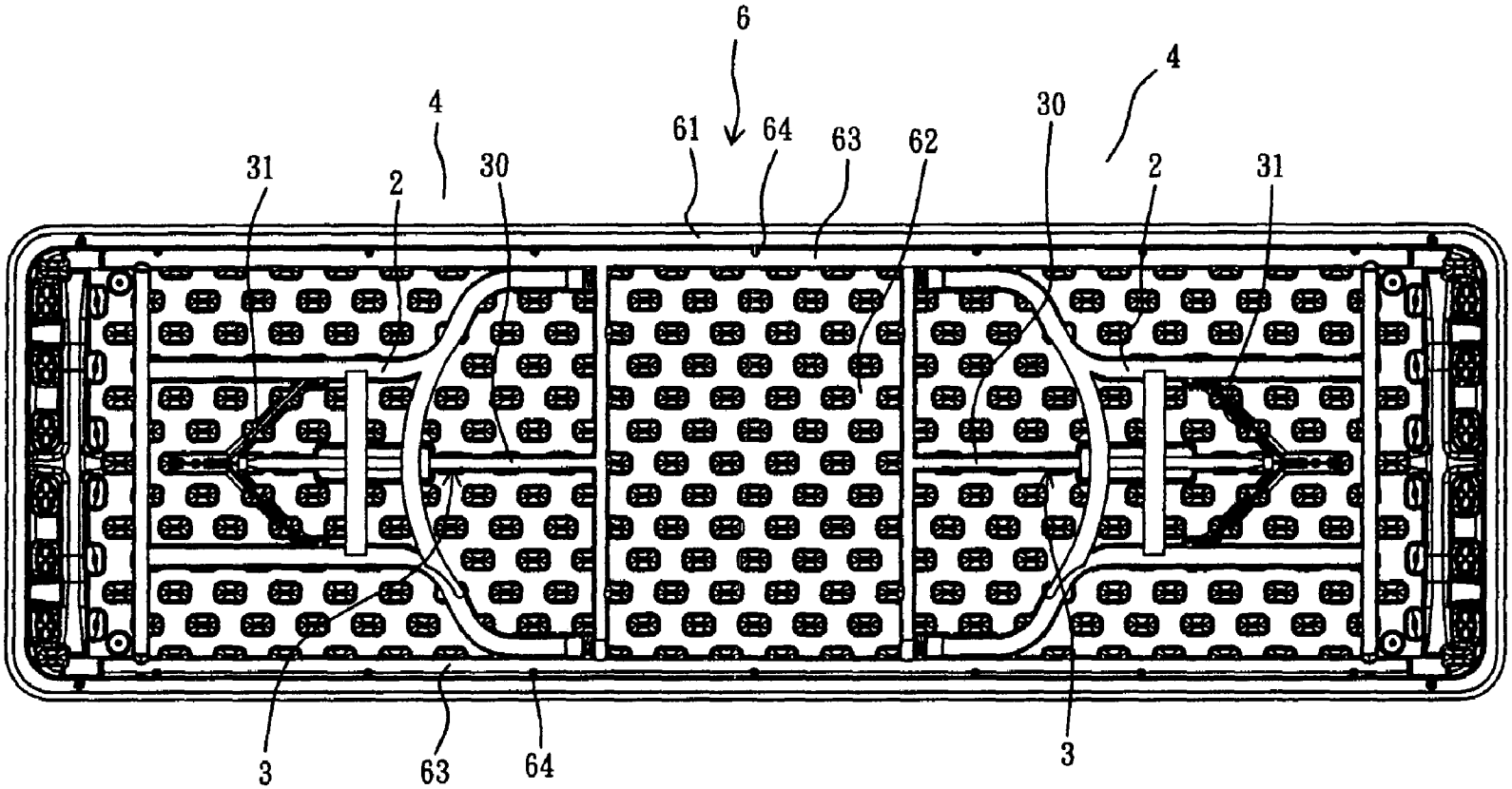
FIG. 10 is a bottom plan folded view of the blow-molded table as shown in FIG. 8.

Referring to FIGS. 8–10, a blow-molded table 6 in accordance with another embodiment of the present invention is shown, wherein the table board 61 has a length greater than that of the table board 1. The bottom of the table board 61 is formed with a receiving space 62. The receiving space 62 of the table board 61 has two opposite sides each provided with a support tube 63 which is secured on the table board 61 by a plurality of screws 64. In such a manner, the support bars 30 of the two support units 3 are spaced from each other as shown in FIG. 9.

Figure 11:
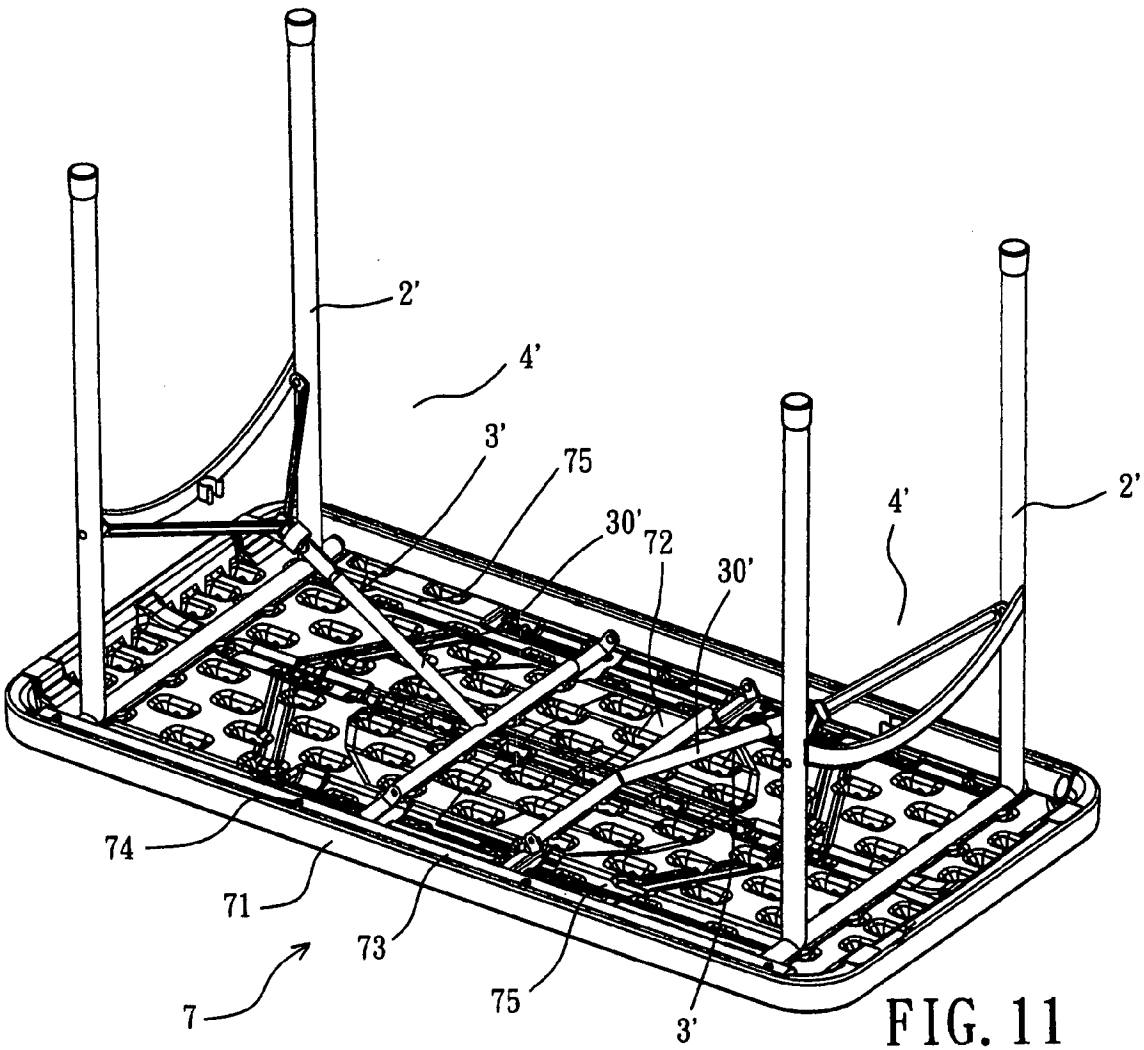
FIG. 11 is a bottom perspective view of a blow-molded table in accordance with another embodiment of the present invention.
Figure 12:
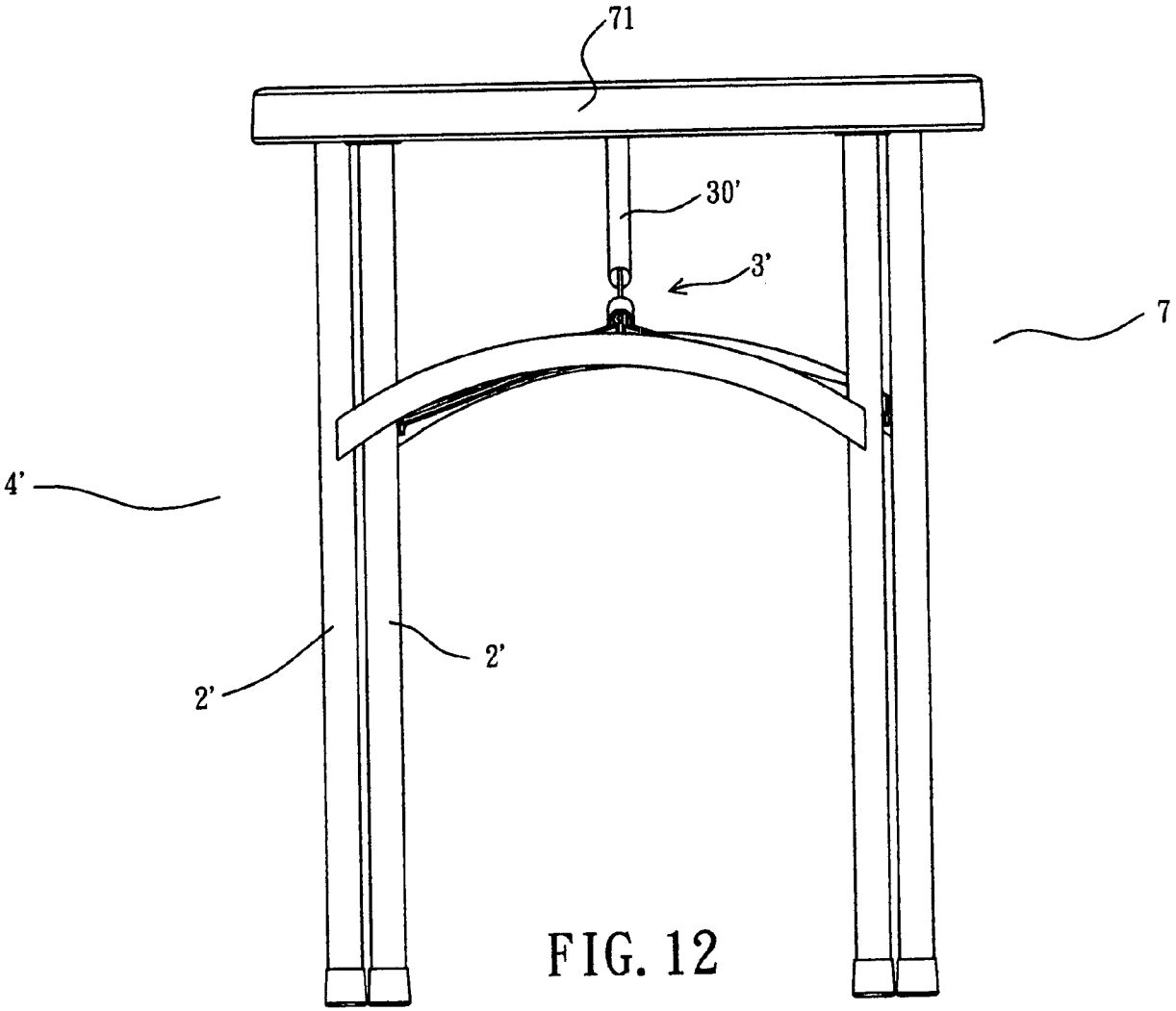
FIG. 12 is a side plan view of the blow-molded table as shown in FIG. 11.
Figure 13:
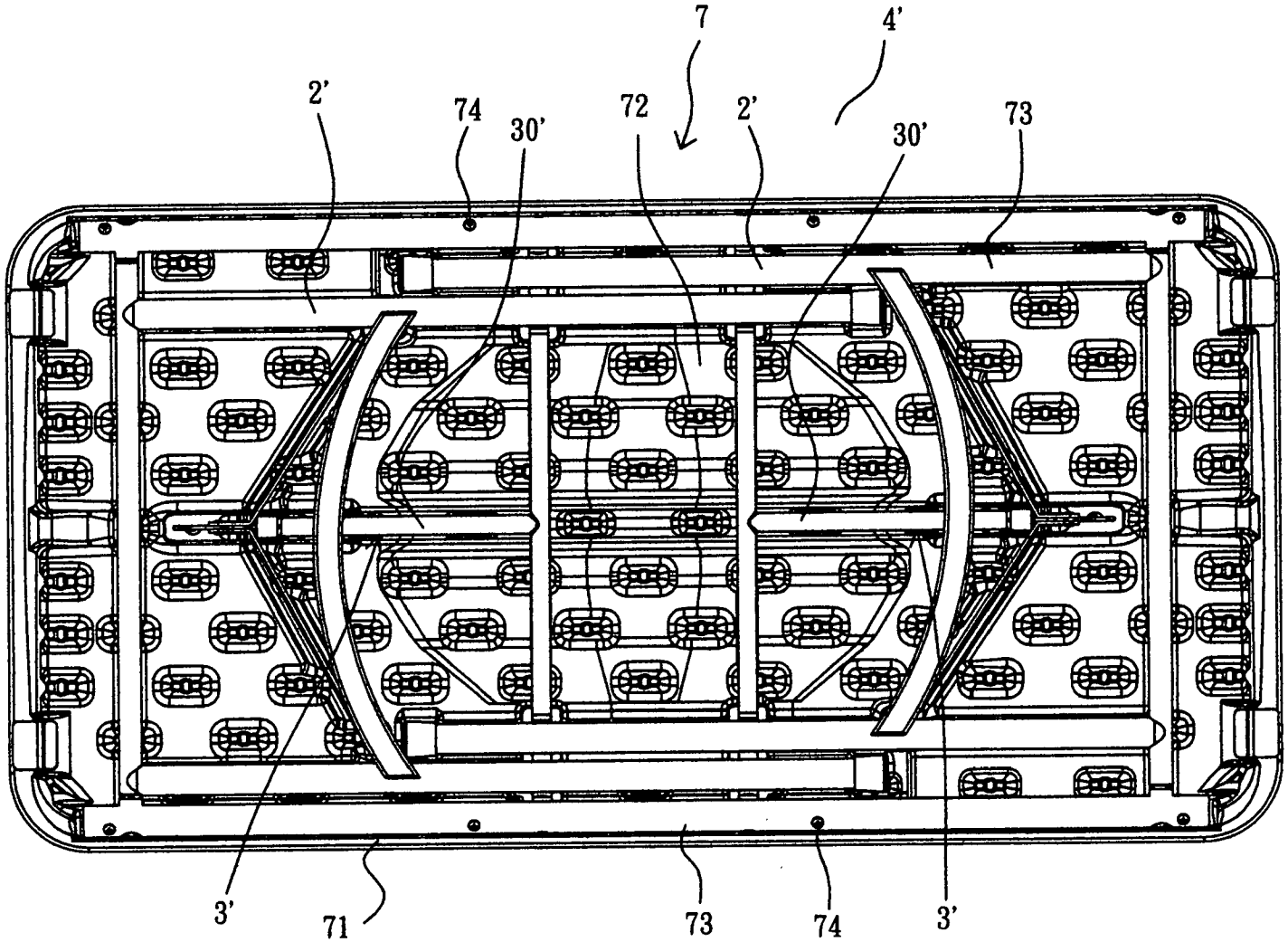
FIG. 13 is a plan folded view of the blow-molded table as shown in FIG. 11.

Referring to FIGS. 11–13, a blow-molded table 7 in accordance with another embodiment of the present invention is shown, wherein the table board 71 has a length smaller than that of the table board 1. The bottom of the table board 71 is formed with a receiving space 72. The receiving space 72 of the table board 71 has two opposite sides each provided with a support tube 73 which is secured on the table board 71 by a plurality of screws 74. The receiving space 72 of the table board 71 is formed with a plurality of receiving recesses 75 for receiving the support stand 2' and the support member 3' of each of the support units 4' when being folded. In such a manner, the support bars 30' of the two support units 3' are spaced from each other as shown in FIG. 11, and the support stands 2' of the two support units 4' are arranged in a staggered manner as shown in FIGS. 12 and 13.

Figure 14:
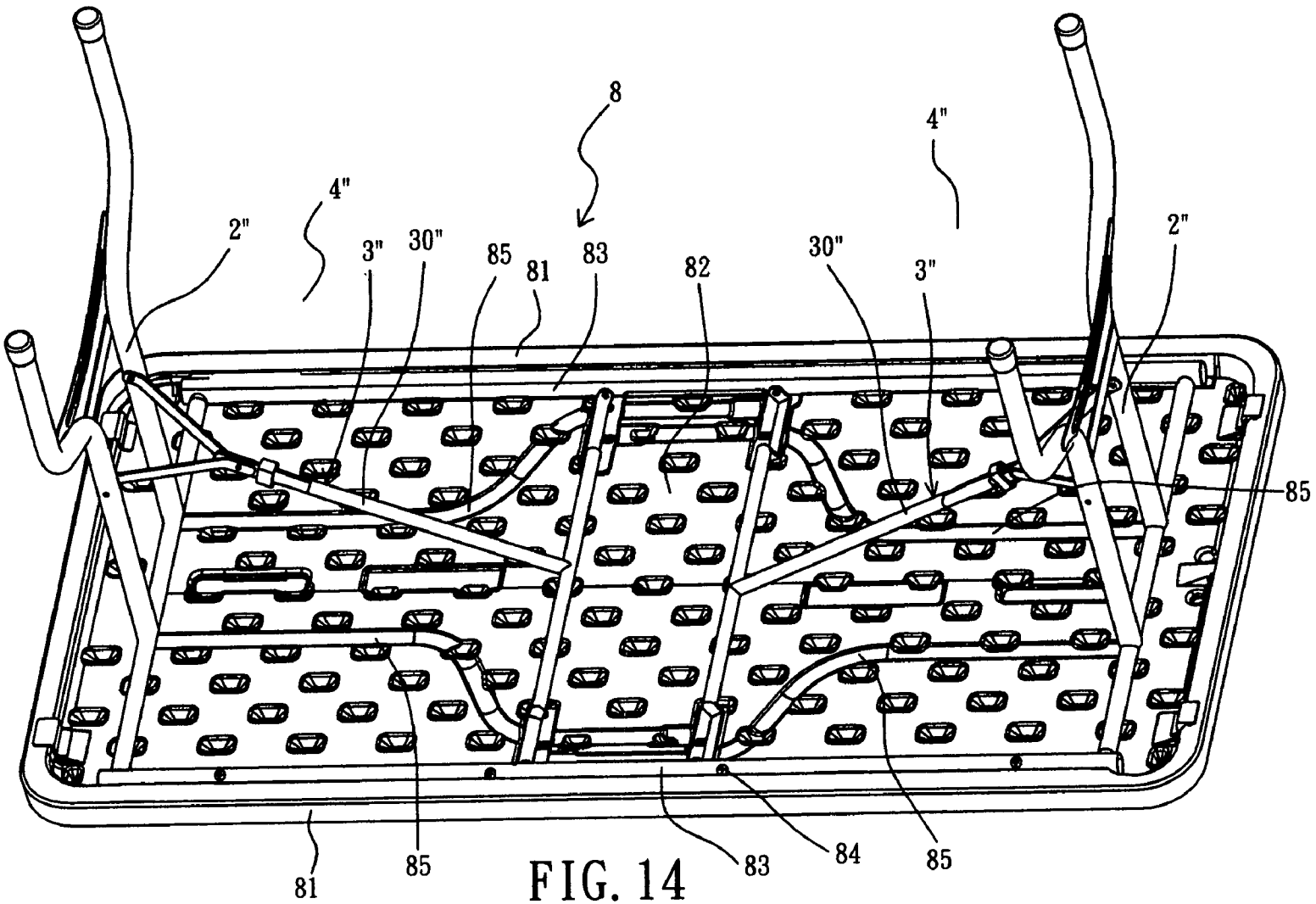
FIG. 14 is a bottom perspective view of a blow-molded table in accordance with another embodiment of the present invention.
Figure 15:
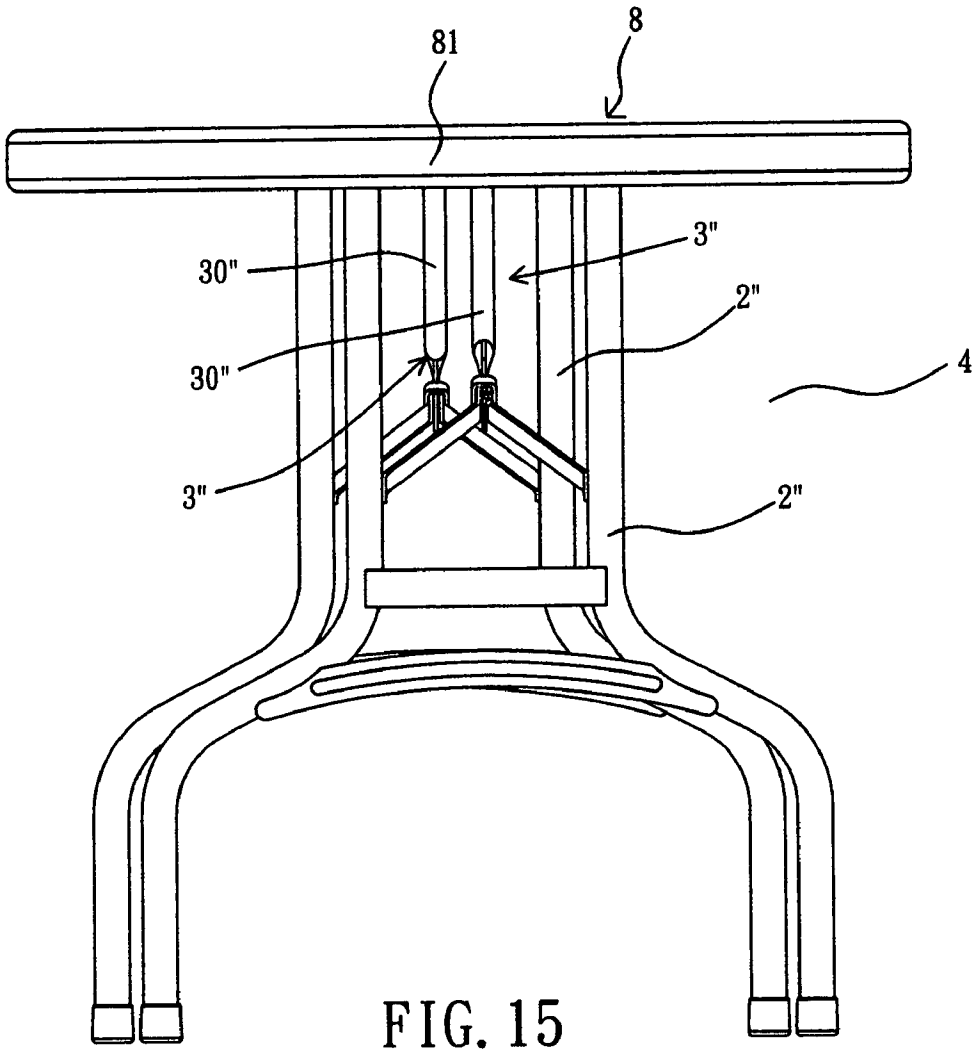
FIG. 15 is a side plan view of the blow-molded table as shown in FIG. 14.
Figure 16:
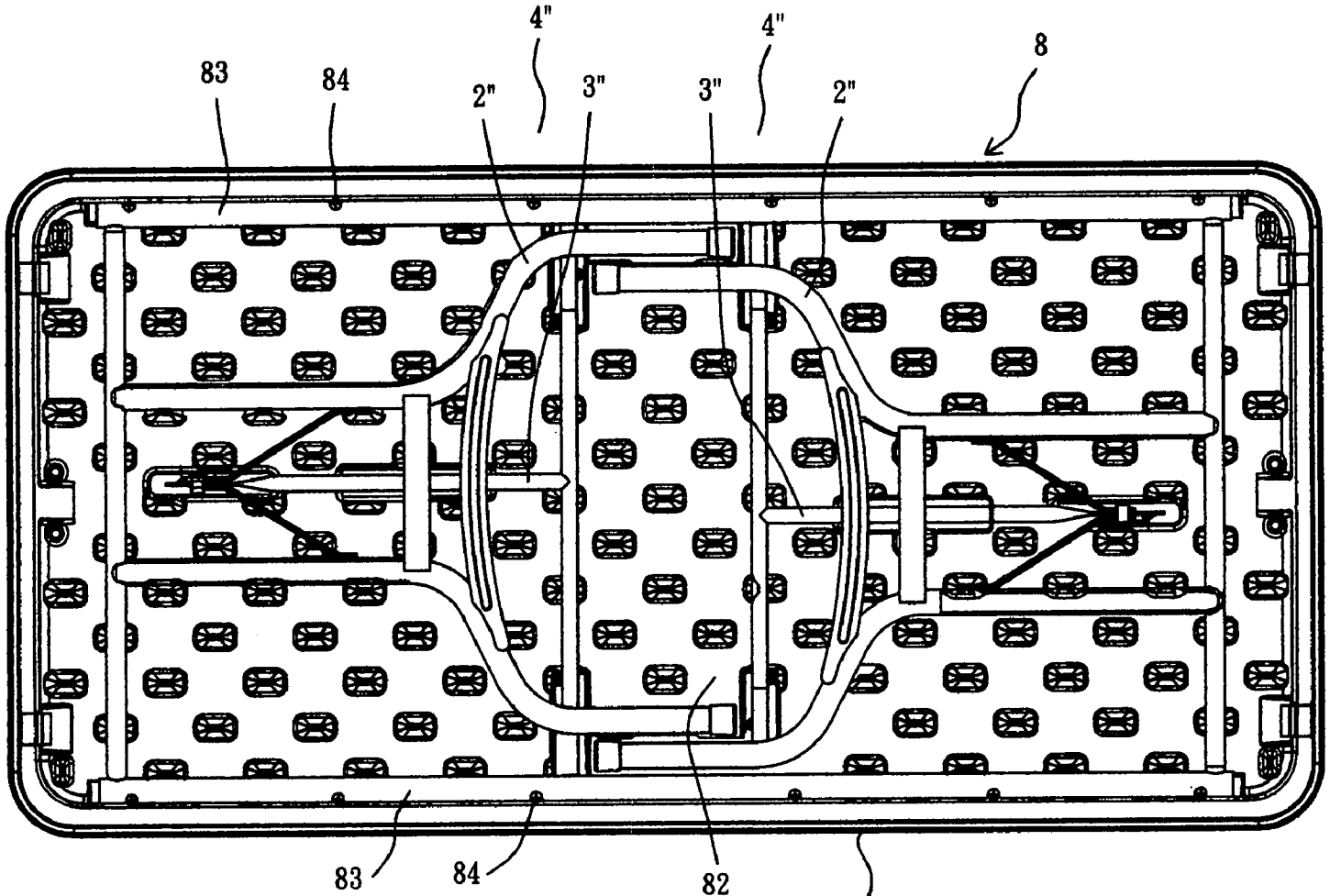
FIG. 16 is a plan folded view of the blow-molded table as shown in FIG. 14.

Referring to FIGS. 14–16, a blow-molded table 8 in accordance with another embodiment of the present invention is shown, wherein the table board 81 has a length smaller than that of the table board 1. The bottom of the table board 81 is formed with a receiving space 82. The receiving space 82 of the table board 81 has two opposite sides each provided with a support tube 83 which is secured on the table board 81 by a plurality of screws 84. The receiving space 82 of the table board 81 is formed with a plurality of receiving recesses 85 for receiving the support stand 2" and the support member 3" of each of the support units 4" when being folded. In such a manner, the support bars 30" of the two support units 3" are spaced from each other as shown in FIG. 14, and the support stands 2" of the two support units 4" are arranged in a staggered manner as shown in FIGS. 15 and 16. In addition, the support stand 2" of each of the support units 4" has a narrower upper portion and a wider lower portion as shown in FIG. 15.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A collapsible table comprising:

a blow-molded table top having an upper surface and a lower surface;

a pair of opposing support stands pivotally attached to the lower surface of the table top, the support stands operable to be positioned in an extended position in which the support stands are disposed substantially perpendicular to the lower surface of the table top and in a collapsed position in which the support stands are disposed substantially parallel to the lower surface of the table top, each support stand comprising:

a pair of support legs separated by a distance;

a reinforcement member attached to the support legs and spanning the distance between the support legs; and a substantially C-shaped holder disposed between the support legs and attached to the reinforcement member;

a pair of articulated support bars, each having a first end pivotally attached to the lower surface of the table top, a second end pivotally connected to a corresponding one of the support stands, and a central portion disposed between the first and second ends, the central portion for engaging the substantially C-shaped holder of the corresponding support stand, the support bars operable to be positioned in an extended position in which the support bars are disposed at an angle to the lower surface of the table top for bracing the support stands in the extended position, the support bars further operable to be positioned in a collapsed position in which the support bars are disposed substantially parallel to the lower surface of the table top;

wherein, as the support stands and support bars move from the extended position to the collapsed position, the substantially C-shaped holder of each support stand engages the central portion of a corresponding one of the support bars, thereby preventing the support stand from inadvertently moving from the collapsed position to the extended position.

2. The collapsible table of claim 1 wherein the second end of each of the support bars comprises a pivotally-connected V-shaped brace having a pair of prong members that pivotally attach to the pair of support legs of the corresponding support stand.

3. The collapsible table of claim 1 wherein the lower surface of the table top includes a recess for receiving at least a portion of the C-shaped holder of each support stand when the support stand is in the collapsed position.

4. The collapsible table of claim 1 wherein the reinforcement member comprises an arched brace.

5. The collapsible table of claim 1 wherein the reinforcement member comprises a substantially linear brace.

* * * * *